US006820442B2

(12) United States Patent
Kimura

(10) Patent No.: US 6,820,442 B2
(45) Date of Patent: Nov. 23, 2004

(54) PERSONAL ORNAMENT

(76) Inventor: Toshihiko Kimura, 202 #, Kichijoji-honcho 1-chome, Musashino (JP)

( * ) Notice: Subject to any disclaimer, the term of this patent is extended or adjusted under 35 U.S.C. 154(b) by 69 days.

(21) Appl. No.: 10/129,420

(22) PCT Filed: Mar. 15, 2002

(86) PCT No.: PCT/JP02/02528

§ 371 (c)(1),
(2), (4) Date: May 1, 2002

(87) PCT Pub. No.: WO03/077699

PCT Pub. Date: Sep. 25, 2003

(65) Prior Publication Data

US 2003/0172673 A1 Sep. 18, 2003

(51) Int. Cl.[7] ..... A44C 17/02
(52) U.S. Cl. ..... 63/31; 63/29.1; 63/15
(58) Field of Search ..... 63/15, 26, 291, 63/31

(56) References Cited

U.S. PATENT DOCUMENTS 915,678 A * 3/1909 Kantor et al. ..... 63/31
922,212 A * 5/1909 Tropin ..... 63/31
2,585,183 A * 2/1952 Stern ..... 63/15
4,187,697 A * 2/1980 Castelo ..... 63/31
4,220,017 A * 9/1980 Freeman ..... 63/15
4,726,200 A * 2/1988 Carter ..... 63/15
4,970,878 A * 11/1990 Lee ..... 63/23
4,977,757 A * 12/1990 Mesica et al. ..... 63/15
5,787,731 A * 8/1998 Ebara ..... 63/29.1
5,950,456 A * 9/1999 Kirsch, Jr. ..... 63/31
6,612,132 B2 * 9/2003 Kimura et al. ..... 63/31

* cited by examiner

*Primary Examiner*—J J Swann
*Assistant Examiner*—Thomas Ho
(74) *Attorney, Agent, or Firm*—Jordan and Hamburg LLP

(57) ABSTRACT

A personal ornament including a support member assembly; a pair of support members formed so as to project upwardly in order that the support member assembly at predetermined space; axle holes formed a part in corresponding to the support members, respectively; a gemstone support bracket located movably between the support members and a pair of support axles provided at a part in corresponding to the axle holes of the support member of the gemstone support bracket. The gemstone support bracket is attached to a gemstone including a diamond. The support axles are formed with an inclined face at the lower part which is supported at lower part adjacent to an opening end of the axle hole so that the position of the center of gravity of the gemstone changes and its motion also shakes automatically by motion of small support member.

16 Claims, 16 Drawing Sheets

PERSONAL ORNAMENT

BACKGROUND ART

The present invention relates generally to personal ornaments including a ring, necklace, pendant, earring, bracelet, broach, tie holder or cuff links.

A significant disadvantage associated with the usual personal ornaments listed was, that by mounting gemstones in the support member which is equipped with a chain or ring part put on a person's finger, the gemstones were always displayed in a fixed condition.

Since the personal ornaments including a ring, necklace, pendant, earring, bracelet, broach, tie holder or cuff links create a beauty according to the reflective condition of the light which shines upon gemstone including a diamond or is planning whether it is conspicuous, however gemstones are fixedly mounted to the support member, there were problem that There can be few motions of gemstone including a diamond and cannot make it shine.

Accordingly, the position of the center of gravity of gemstone including a diamond changes and its motion also shakes automatically by motion of small support member, and brightness of gemstone such as a diamond attached to the gemstone support bracket can demonstrate the brightness to the maximum extent.

The novel features which are believed to be characteristic of the invention, both as to its organization and method of operation, together with further objects and advantages thereof, are described below with reference to the accompanying drawings in which a presently preferred embodiment of the invention is illustrated as an example.

It is to be expressly understood, however, that the drawings are for the purpose of illustration and description only, and are not intended as a definition of the limits of the invention.

DISCLOSURE OF THE INVENTION

Accordingly, a personal ornament comprises a support member assembly; a pair of support members formed so as to project upwardly in order that the support member assembly at predetermined space; axle holes formed a part in corresponding to the support members, respectively; a gemstone support bracket located movably between the support members, being attached to a gemstone including diamond; and a pair of support axles provided at a part in corresponding to the axle holes of the support member of the gemstone support bracket, being formed inclined face at the lower part which is supported at lower part adjacent to an opening end of the axle hole.

BEST MODE FOR CARRYING OUT THE INVENTION

Figure 1:
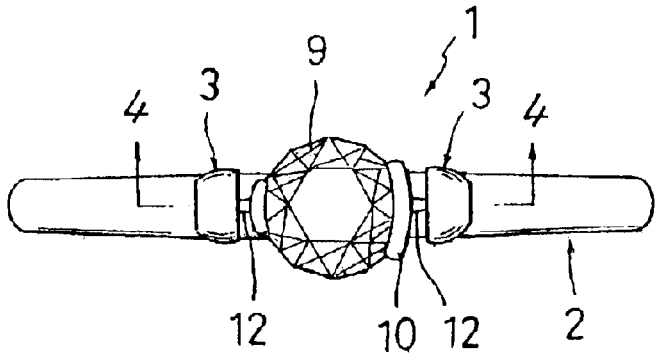
FIG. 1 is a plan view showing a first embodiment of the present invention.
Figure 2:
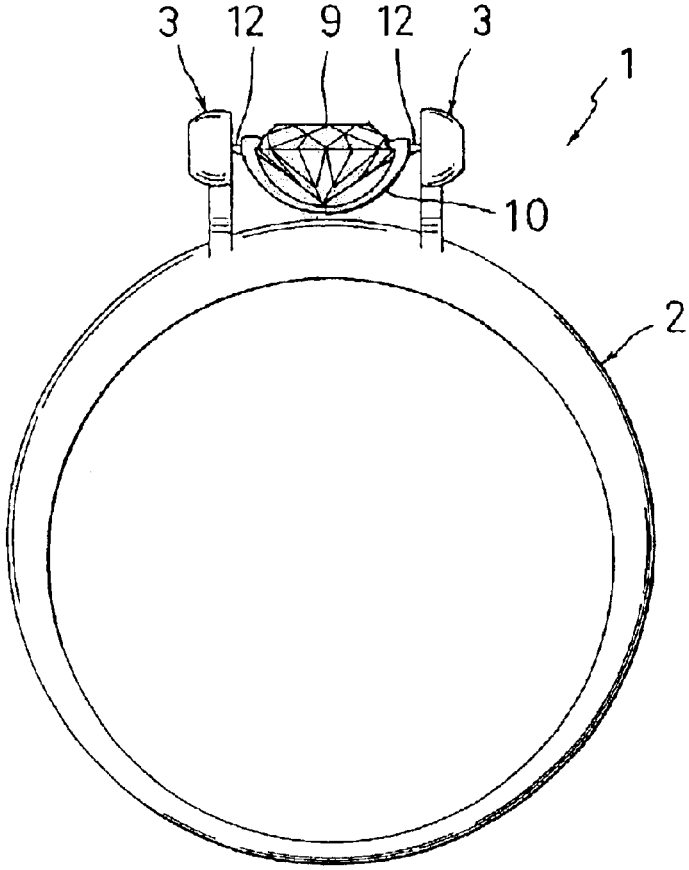
FIG. 2 is a front view showing the first embodiment of the present invention.
Figure 3:
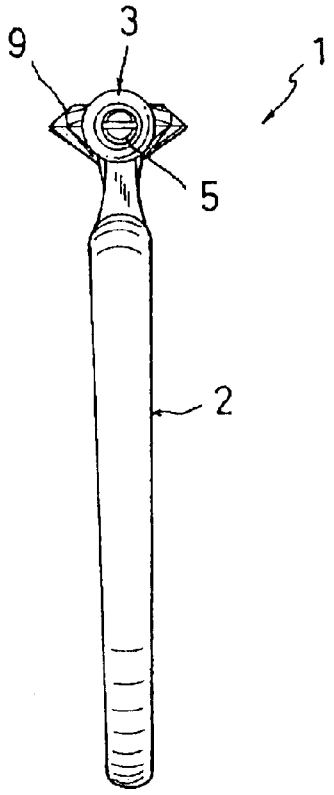
FIG. 3 is a side view showing the first embodiment of the present invention.
Figure 4:
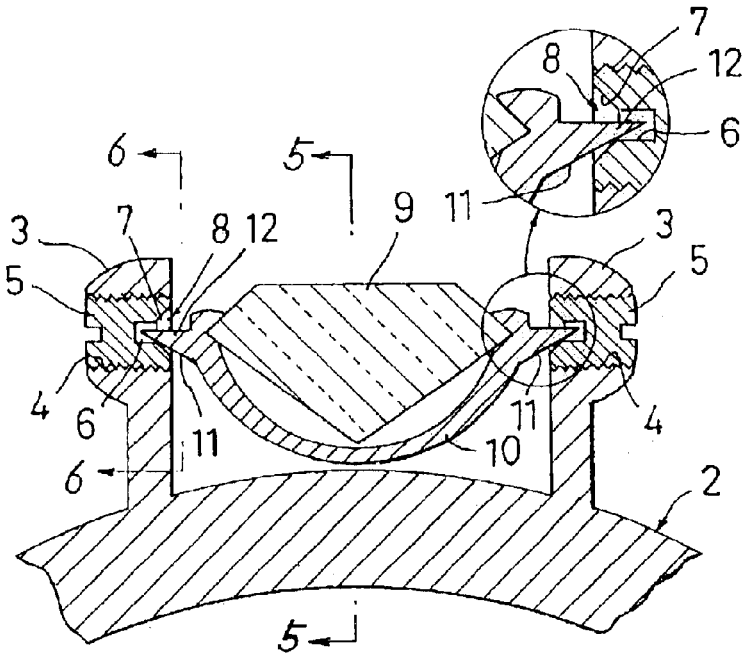
FIG. 4 is an expanded sectional view taken through line 4—4 showing of FIG. 1.
Figure 5:
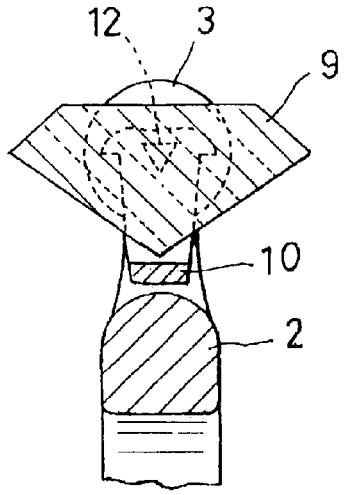
FIG. 5 is a cross sectional view taken through line 5—5 showing of FIG. 4.
Figure 6:
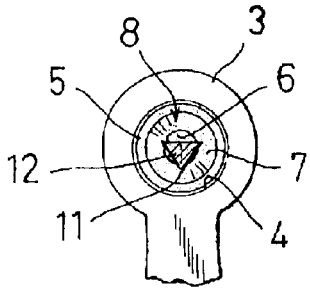
FIG. 6 is a cross sectional view taken through line 6—6 showing of FIG. 4.
Figure 7:
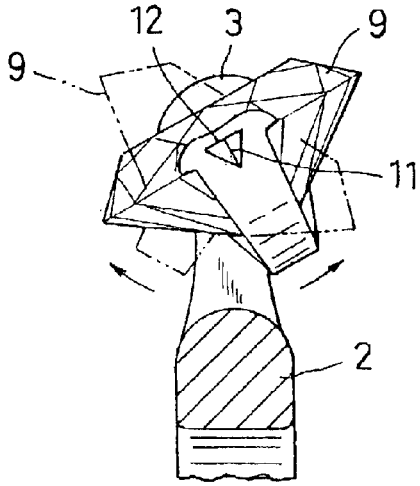
FIG. 7 is an explanation view of the way in which the gemstones swings.

Preferred embodiments of the present invention are described in more detail below referring to the accompanying drawings.

An understanding of the present invention may be best gained by reference FIGS. 1 to 7. FIGS. 1 to 7 illustrate a winding device of a first embodiment of the present invention.

A personal ornament 1 as a ring comprises a support member assembly 2, a pair of support members 3, 3, screw holes 4, 4, bolts 5, 5, axle holes 8, 8, a gemstone support bracket 10 and a pair of support axles 12, 12.

The support member assembly 2 forms in the shape of a ring which can be worn on one of a person's fingers, which is made of precious material.

The support member 3 is fixedly formed integrally or by using adhesives at outward circumferential part of the support member assembly 2 so as to project upwardly, the space between the support members 3 having a fixed distance.

The screw hole 4 is formed at a center part of the support member 3, and the bolt 5 is inserted into the screw hole 4 and screwed.

The axle holes 8, 8 include a circle hole 6 and a hole 7 formed in the shape of a dish respectively; the circle hole 6 is formed at a tip portion of the axle hole 8; and the dish-shaped hole 7 extending to an opening end thereof, which links to the circle hole 6.

The gemstone support bracket 10 supports gemstone 9 including diamonds positioned to be able to swing between the support members 3, 3.

The support axles 12, 12 are fitted to the part in corresponding to the axle holes 8, 8 formed at the support members 3, 3, respectively, being formed in the shape of a conical or triangular pyramid trapezoid and having slopes 11, 11 at the lower end thereof which is supported and located at the lower part of the opening end of the circle hole of the axle holes 8, 8, respectively.

In the above referred personal ornament 1 used as a ring, after the bolts 5, 5 are located so that the space between the bolts 5 for attachment of the support members become large, the support axles 12 and 12 of the gemstone support bracket 10 which the gemstone 9 including diamond is attached to locate into the axle holes 8 and 8, and the bolts 5, 5 are screwed so that the tip parts of the support axles 12 and 12 locate in the central part of the circular holes 6, 6 respectively, and adhesives is filled up the space between the bolts and holes 4 and 4, as a result it can be prevent to come off the bolts 5, 5.

In the personal ornament 1, used as a ring, which is assembled, the center-of-gravity position of the gemstone support bracket 10 attached the gemstone 9 including diamond thereto changes by movement of the support member assembly 2, and the support bracket shakes so as to turn centering on the support axles 12, 12.

Moreover, since each lower part of the support axles 12, 12 is formed in the shape of a triangular pyramid or a triangular pyramid trapezoid having slopes 11, 11, the support bracket moves in the axial direction centering of the support axles 12, 12 and also moves with shaking so that it automatically locates at the center part.

Other embodiments of the present invention will now be described referring to FIGS. 8 to 46. Through the drawings of the embodiments, like components are denoted by like numerals as of the first embodiment and will not be further explained in great detail.

Figure 8:
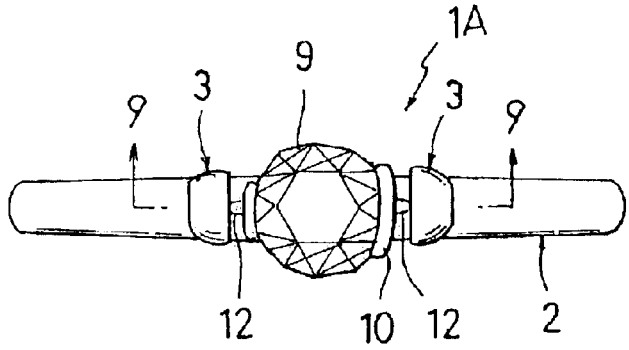
FIG. 8 is a plan view showing a second embodiment of the present invention.
Figure 9:
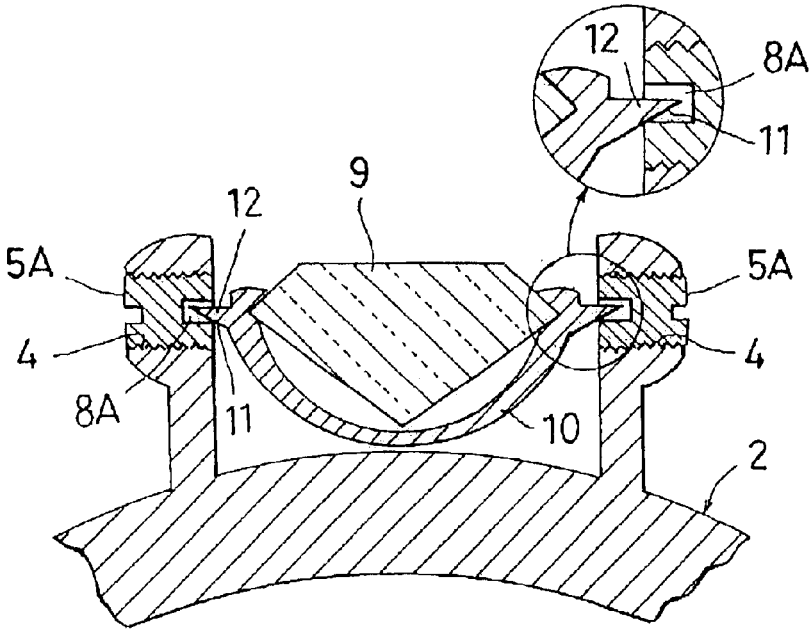
FIG. 9 is an expanded sectional view taken through line 9—9 showing of FIG. 8.
Figure 10:
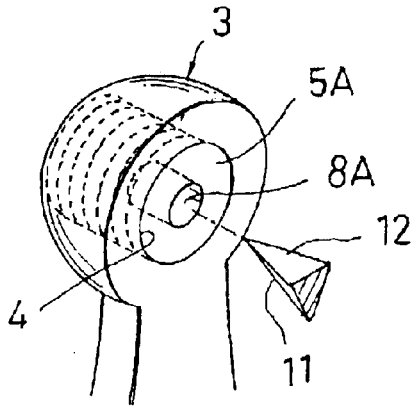
FIG. 10 is an explanation view of a support member showing the second embodiment of the present invention.

A second embodiment of the present invention is shown in FIGS. 8 to 10. It is distinguished from the first embodiment by the fact that the axle hole 8 is replaced with another like axle hole 8A. The axle holes 8A, 8A include only circle hole formed at a tip part of bolts 5A, 5A. A personal ornament 1A with the axle holes 8A, 8A according to the second embodiment has similar advantages to that according to the first embodiment.

Figure 11:
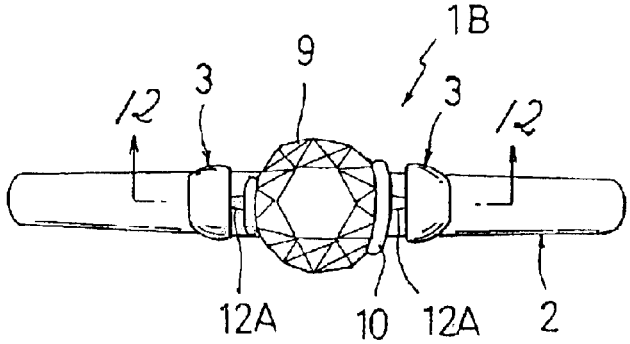
FIG. 11 is a plan view showing a third embodiment of the present invention.
Figure 12:
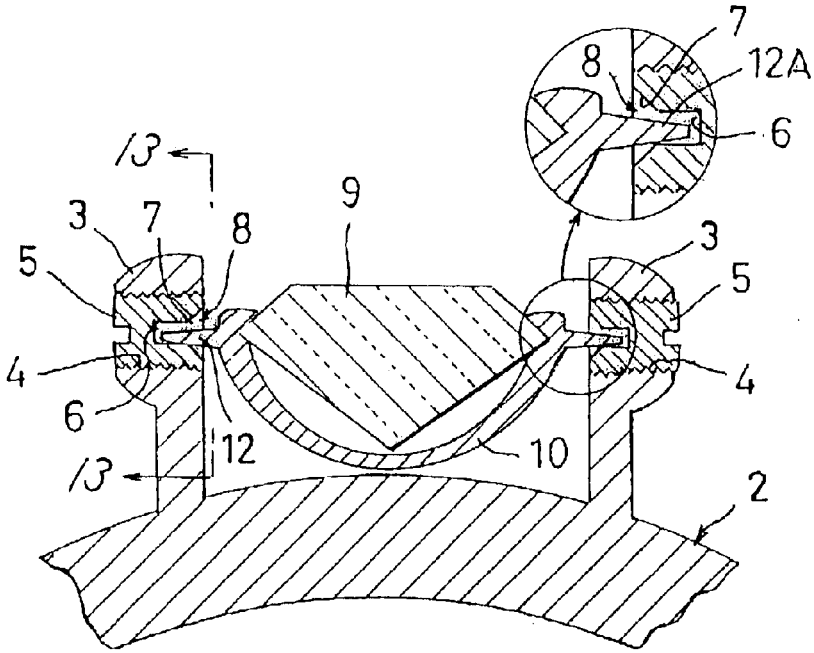
FIG. 12 is an expanded sectional view taken through line 12—12 showing of FIG. 11.
Figure 13:
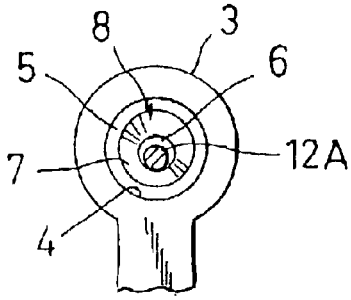
FIG. 13 is a cross sectional view taken through line 13—13 showing of FIG. 12.

A third embodiment of the present invention is shown in FIGS. 11 to 13. It is distinguished from the first embodiment by the fact that a pair of support axles 12A, 12A formed in the shape of circular cone or crucible former is fixed to the gemstone support bracket 10, respectively. A personal ornament 1B with the support axles 12A, 12A according to the third embodiment has similar advantages to that according to the first embodiment.

Figure 14:
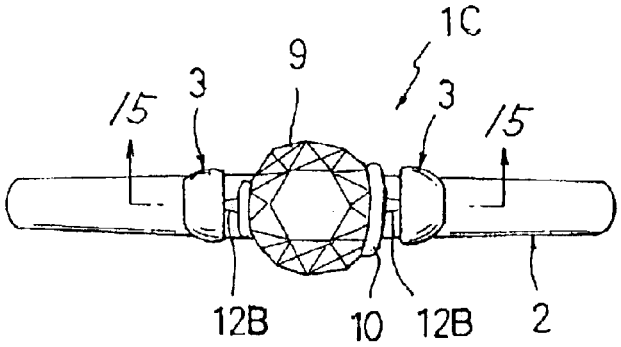
FIG. 14 is a plan view showing a fourth embodiment of the present invention.
Figure 15:
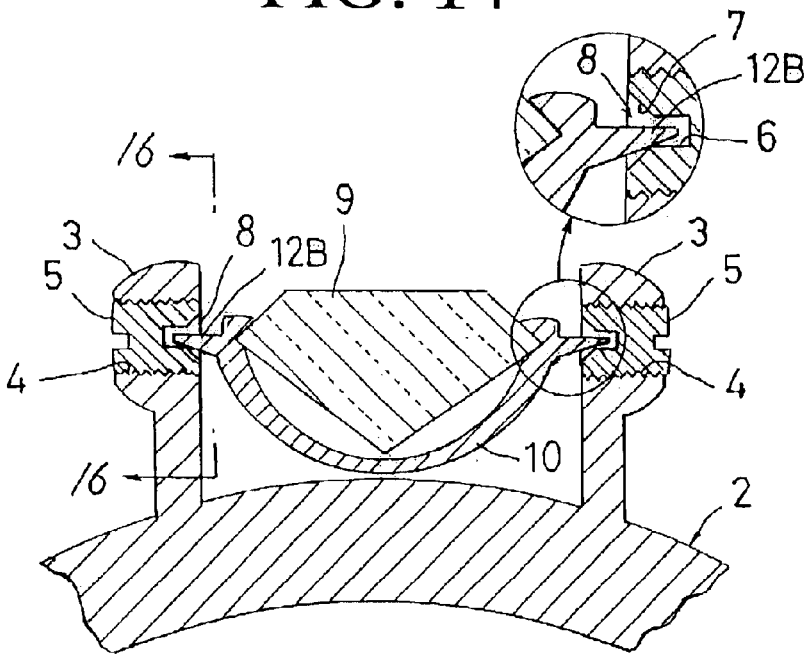
FIG. 15 is an expanded sectional view taken through line 15—15 showing of FIG. 14.
Figure 16:
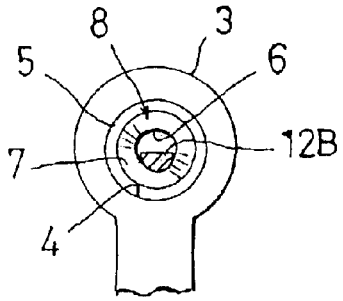
FIG. 16 is a cross sectional view taken through line 16—16 showing of FIG. 15.

A fourth embodiment of the present invention is shown in FIGS. 14 to 16. It is distinguished from the first embodiment by the fact that a pair of support axles 12B, 12B formed in the shape of semi-circular cone or semi-crucible former is fixed to the gemstone support bracket 10, respectively. A personal ornament 1C with the support axles 12B, 12B according to the fourth embodiment has similar advantages to that according to the first embodiment.

Figure 17:
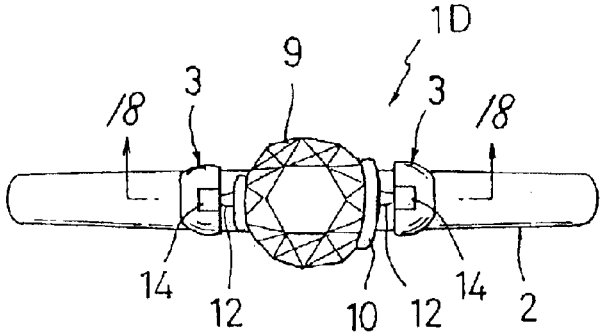
FIG. 17 is a plan view showing a fifth embodiment of the present invention.
Figure 18:
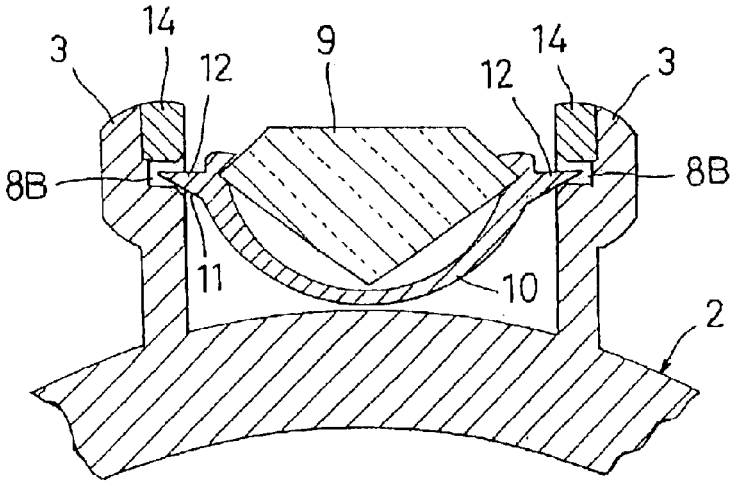
FIG. 18 is an expanded sectional view taken through line 18—18 showing of FIG. 17.
Figure 19:
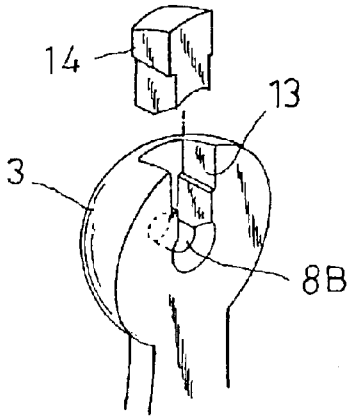
FIG. 19 is an explanation view of a support member showing the fifth embodiment of the present invention.

A fifth embodiment of the present invention is shown in FIGS. 17 to 19. It is distinguished from the first embodiment by the fact that insertion grooves 13, 13 open upwardly and axle holes 8B, 8B are formed at the pair of support members respectively; the axle holes 8B supports the support axles 12, 12 of the gemstone support bracket 10 through the insertion grooves 13; insertion groove covers 14, 14 are engaged fixedly with the insertion groove 13, 13 so as to cover the insertion grooves 13, 13 respectively. A personal ornament 1D according to the fifth embodiment has similar advantages to that according to the first embodiment.

Moreover, in this embodiment, the insertion grooves 13, 13 are provided at side part of the support member 3 respectively.

Figure 20:
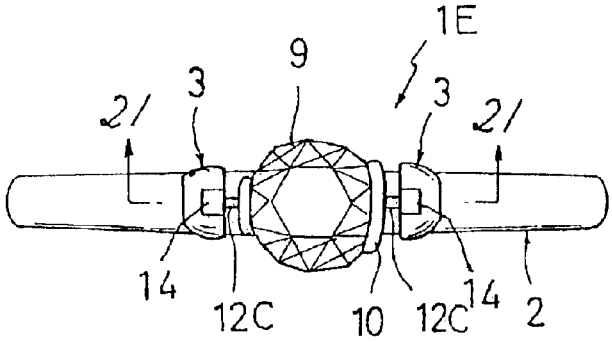
FIG. 20 is a plan view showing a sixth embodiment of the present invention.
Figure 21:
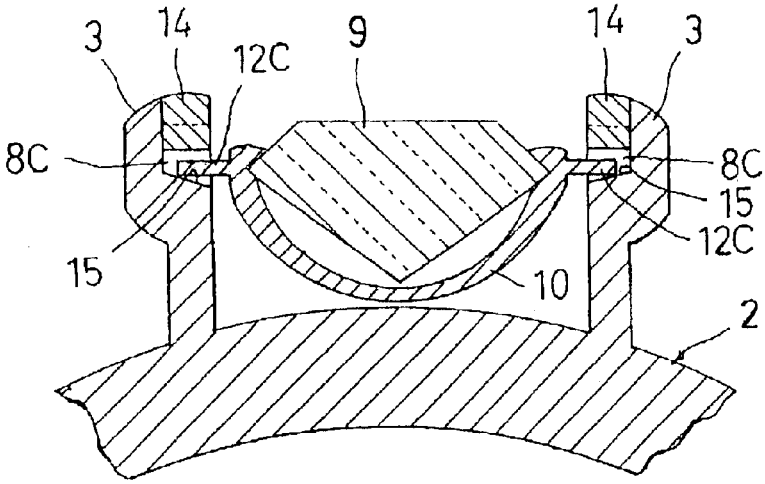
FIG. 21 is an expanded sectional view taken through line 21—21 showing of FIG. 20.
Figure 22:
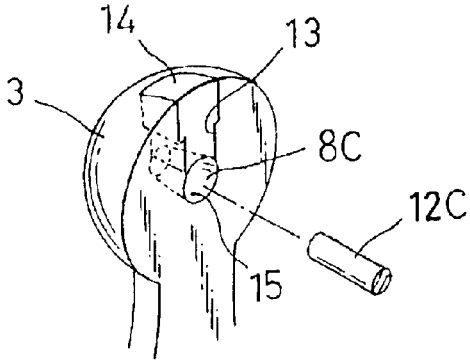
FIG. 22 is an explanation view of a support member showing the sixth embodiment of the present invention.

A sixth embodiment of the present invention is shown in FIGS. 20 to 22. It is distinguished from the fifth embodiment by the fact that a pair of column-shaped support member 12C, 12C is fixed to the gemstone support member 10, and the support members 3, 3 includes axle holes 8C, 8C, respectively, including inclined planes 15, 15 formed at lower part thereof, which expands to the opening end. A personal ornament 1E according to the sixth embodiment has similar advantages to that according to the fifth embodiment.

Figure 23:
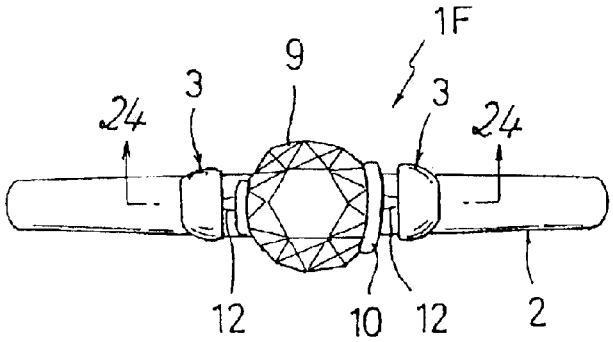
FIG. 23 is a plan view showing a seventh embodiment of the present invention.
Figure 24:
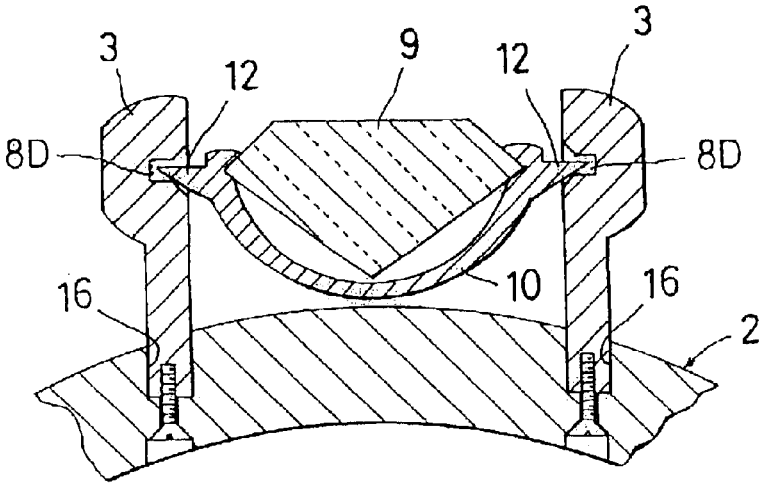
FIG. 24 is an expanded sectional view taken through line 24—24 showing of FIG. 23.
Figure 25:
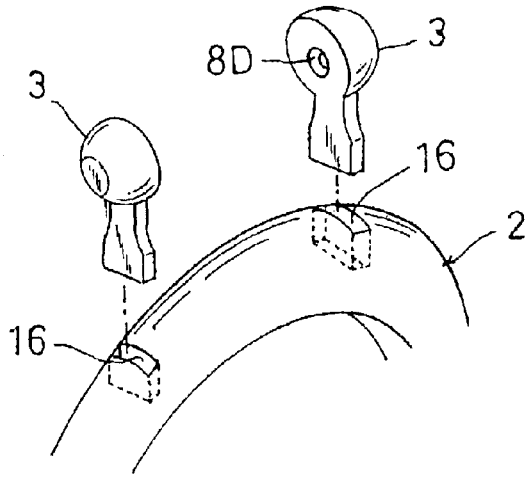
FIG. 25 is an explanation view of a support member showing the seventh embodiment of the present invention.

A seventh embodiment of the present invention is shown in FIGS. 23 to 25. It is distinguished from the first embodiment by the fact that axle holes 8D, 8D are formed at the support members 3, 3 directly, respectively, and the support members 3, 3 are engaged fixedly with concave portions 16, 16 formed at the support member assembly 2. A personal ornament 1F according to the seventh embodiment has similar advantages to that according to the first embodiment.

Moreover, in this embodiment, the support members 3, 3 may be fixed to the support member assembly 2 by adhesives or screwing the bolt.

Figure 26:
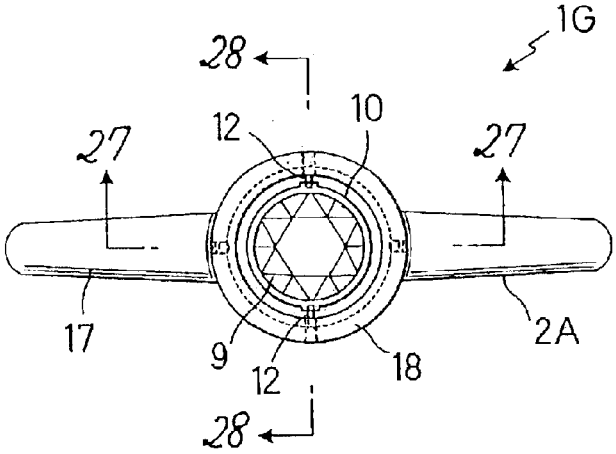
FIG. 26 is a plan view showing a eighth embodiment of the present invention.
Figure 27:
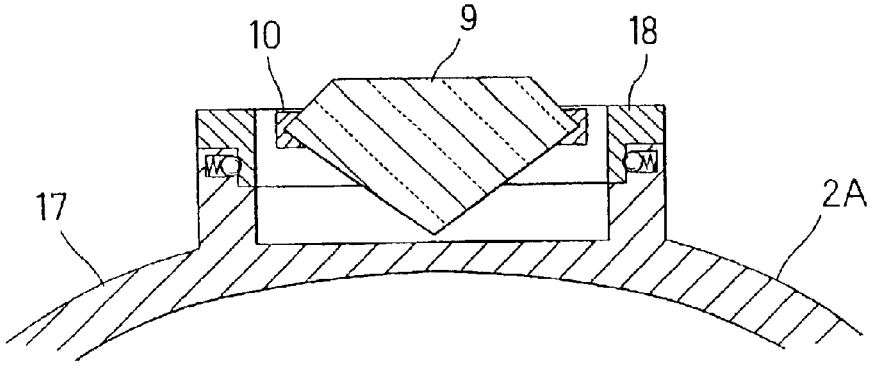
FIG. 27 is an expanded sectional view taken through line 27—27 showing of FIG. 26.
Figure 28:
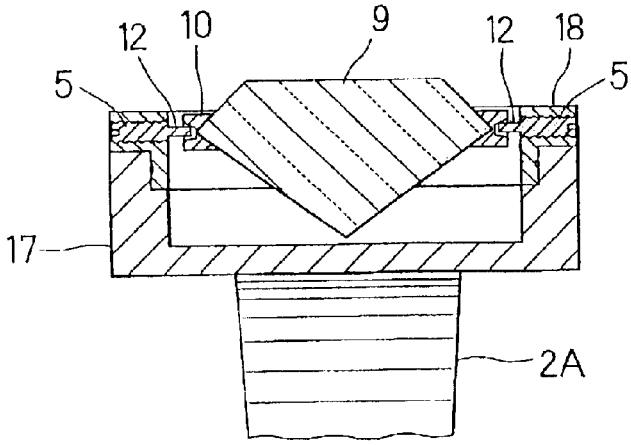
FIG. 28 is a cross sectional view taken through line 28—28 showing of FIG. 26.

An eighth embodiment of the present invention is shown in FIGS. 26 to 28. It is distinguished from the first embodiment by the fact that the support member assembly 2 is replaced with another like assembly 2A. The support member assembly 2A comprises a support member body 17 which is formed in the shape of a ring which can be worn on one of a person's fingers and a rotation member 18 including the pair of support members 3, 3 attached to a top part of the support member body 17 rotatably or rotatably at a fixed degree. A personal ornament 1G with the support member assembly 2A according to the seventh embodiment has similar advantages to that according to the first embodiment and can be used the gemstone support bracket having gemstone 9 including a diamond so as to swing smoothly by rotating the rotation member 18.

Figure 29:
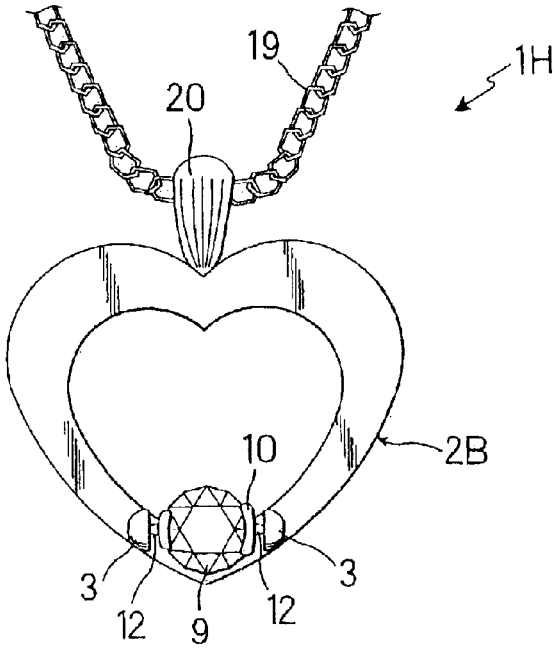
FIG. 29 is a plan view showing a ninth embodiment of the present invention.
Figure 30:
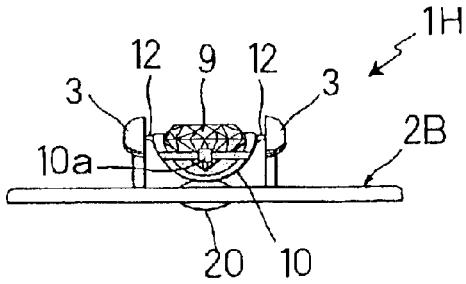
FIG. 30 is a front view showing the ninth embodiment of the present invention.
Figure 31:
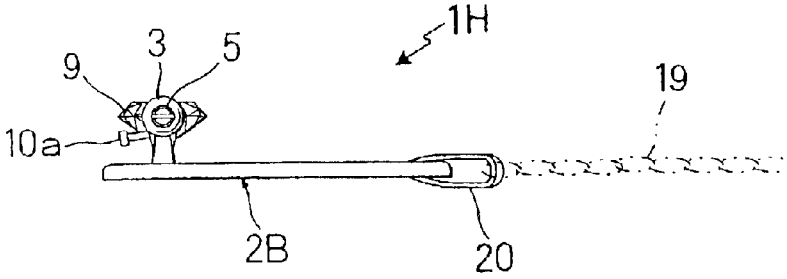
FIG. 31 is a side view showing the ninth embodiment of the present invention.

A ninth embodiment of the present invention is shown in FIGS. 29 to 31. It is distinguished from the first embodiment by the fact that the support member assembly 2 is replaced with another like assembly 2B. The support member assembly 2B is formed in the shape so as to be able to use as a necklace, in a shape of a heart in this embodiment, including a hanging ring 20 which supports a chain 19 and a weight 10*a* which balance the gemstone 9 so as to position at the front. A personal ornament 1H according to the ninth embodiment has similar advantages to that according to the first embodiment and is suited to use as a necklace.

Figure 32:
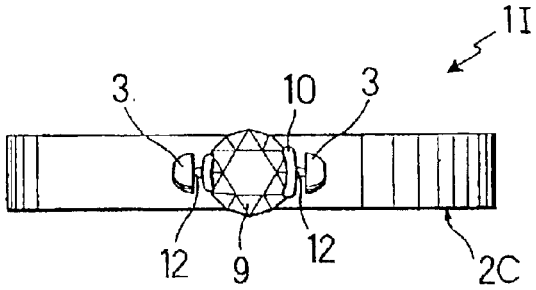
FIG. 32 is a plan view showing a tenth embodiment of the present invention.
Figure 33:
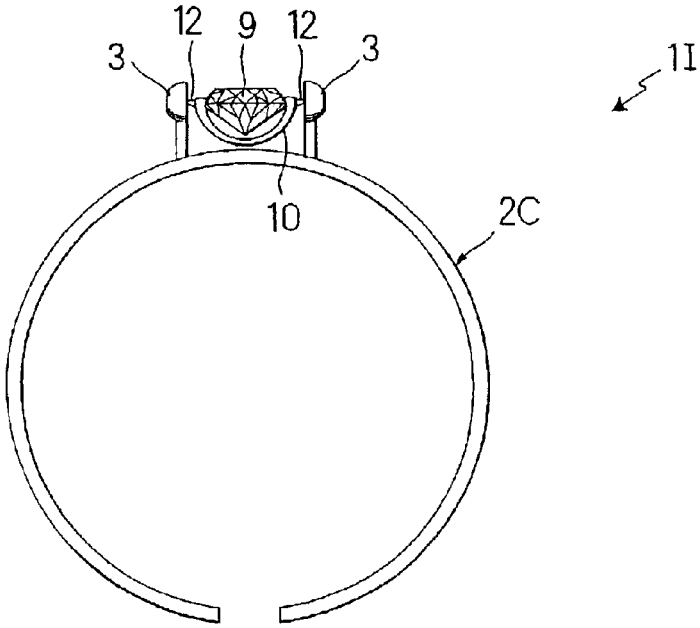
FIG. 33 is a front view showing the tenth embodiment of the present invention.
Figure 34:
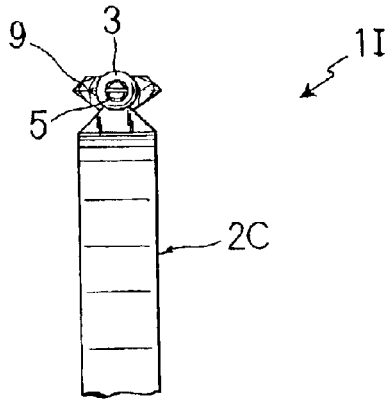
FIG. 34 is a side view, partly in cross section showing the tenth embodiment of the present invention.

A tenth embodiment of the present invention is shown in FIGS. 32 to 34. It is distinguished from the first embodiment by the fact that the support member assembly 2 is replaced with another like assembly 2C. The support member assembly 2C is formed in the shape of a ring having C-letter shape so as to wear on one of a person's wrist. A personal ornament 1I according to the tenth embodiment has similar advantages to that according to the first embodiment and is suited to use as a bracelet.

Figure 35:
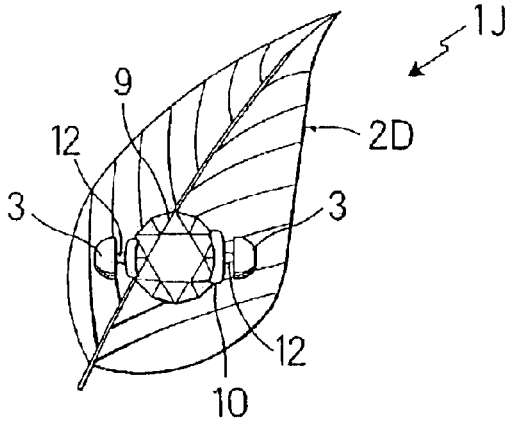
FIG. 35 is a plan view showing a eleventh embodiment of the present invention.
Figure 36:
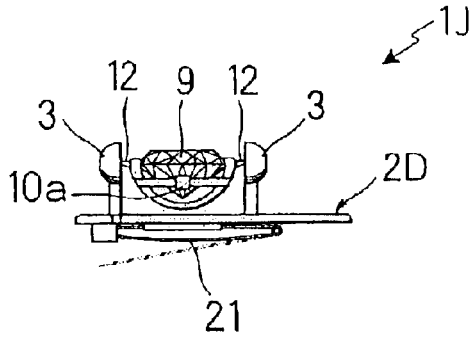
FIG. 36 is a front view showing the eleventh embodiment of the present invention.
Figure 37:
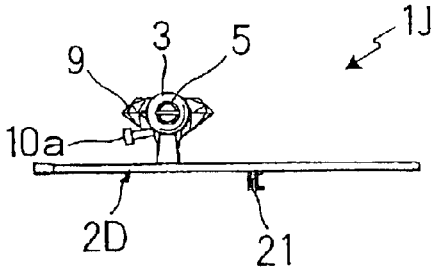
FIG. 37 is a side view showing the eleventh embodiment of the present invention.

An eleventh embodiment of the present invention is shown in FIGS. 35 to 37. It is distinguished from the ninth embodiment by the fact that the support member assembly 2B is replaced with another like assembly 2D. The support member assembly 2D is formed at the voluntary shape so as to use as a brooch, a leaf shape in this embodiment. Moreover, the support member assembly 2D includes a safety pin 21 on the back face of the support member assembly 2D. A personal ornament 1J according to the eleventh embodiment has similar advantages to that according to the ninth embodiment and is suited to use as a brooch.

In addition, in this embodiment, the support member assembly 2D maybe included the means for engaging, which engages removably with the tip part of a clip or pin in place of the safety pin 21.

Figure 38:
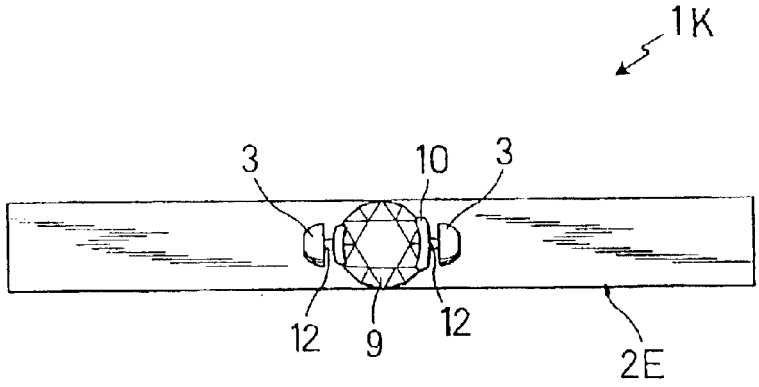
FIG. 38 is a plan view showing a twelfth embodiment of the present invention.
Figure 39:
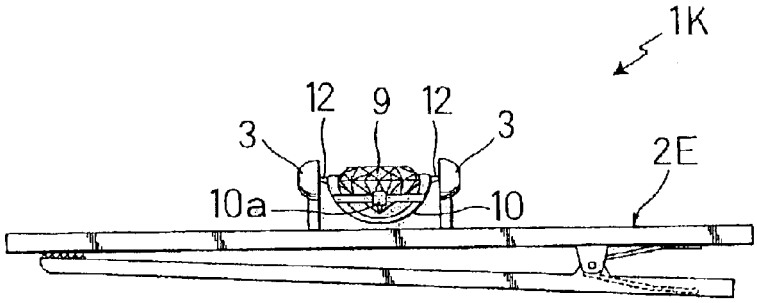
FIG. 39 is a front view showing the twelfth embodiment of the present invention.
Figure 40:
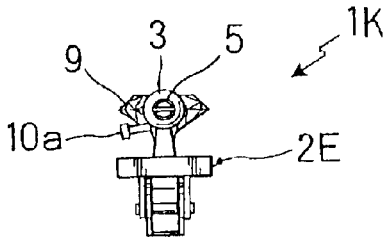
FIG. 40 is a side view showing the twelfth embodiment of the present invention.

A twelfth embodiment of the present invention is shown in FIGS. 38 to 40. It is distinguished from the ninth embodiment by the fact that the support member assembly 2B is replaced with another like assembly 2E formed in the shape of a clip as a voluntary shape so as to be able to use as a tie holder. A personal ornament 1K with the support member assembly 2E according to the twelfth embodiment has similar advantages to that according to the ninth embodiment and is suited to use as tie holder.

Figure 41:
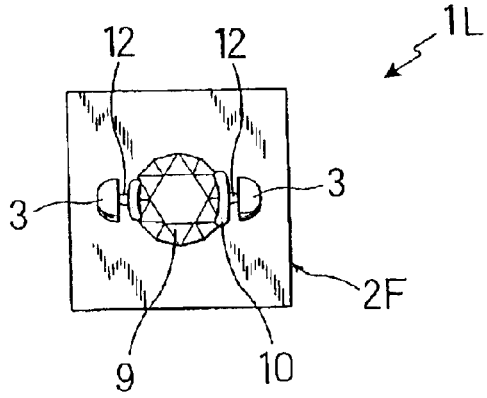
FIG. 41 is a plan view showing a thirteenth embodiment of the present invention.
Figure 42:
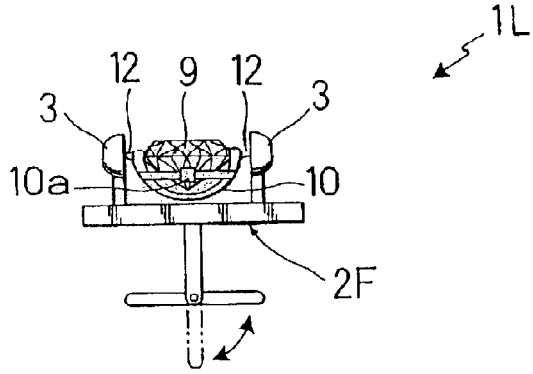
FIG. 42 is a front view showing the thirteenth embodiment of the present invention.
Figure 43:
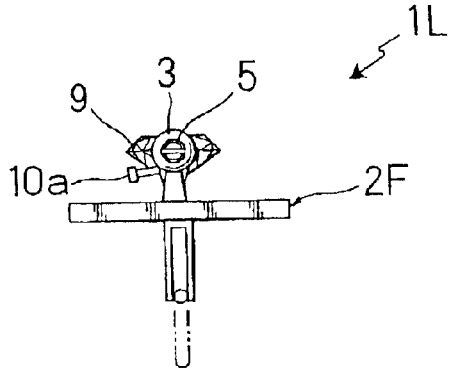
FIG. 43 is a side view showing the thirteenth embodiment of the present invention.

A thirteenth embodiment of the present invention is shown in FIGS. 41 to 43. It is distinguished from the ninth embodiment by the fact that the support member assembly 2B is replaced with another like assembly 2F formed in the shape of a cuff links as a voluntary shape so as to be able to use as cuff links. A personal ornament 1L with the support member assembly 2F according to the thirteenth embodiment has similar advantages to that according to the ninth embodiment and is suited to use as cuff links.

Figure 44:
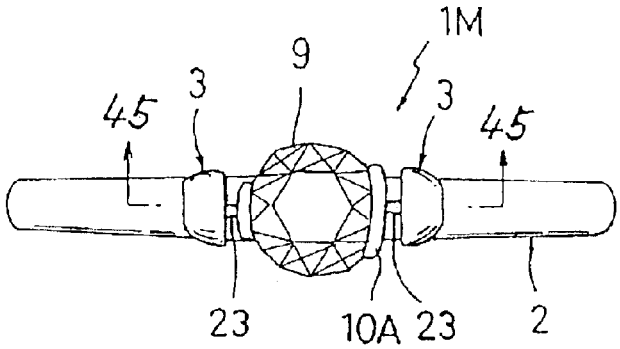
FIG. 44 is a plan view showing a fourteenth embodiment of the present invention.
Figure 45:
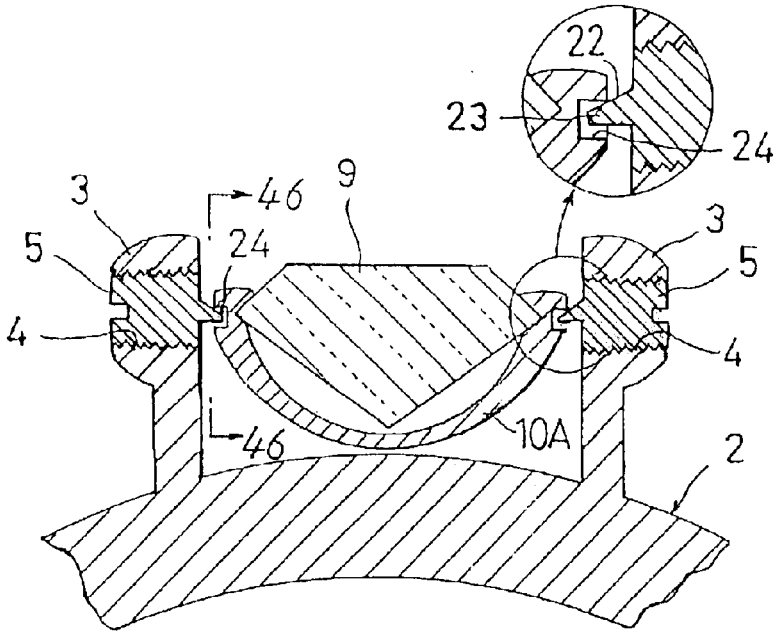
FIG. 45 is an expanded sectional view taken through line 25—25 showing of FIG. 44.
Figure 46:
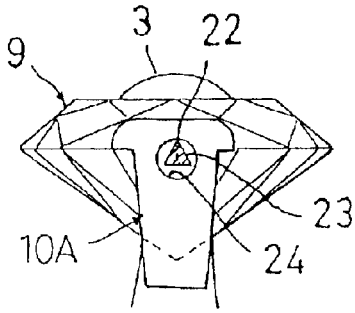
FIG. 46 is a cross sectional view taken through line 26—26 showing of FIG. 45.

A fourteenth embodiment of the present invention is shown in FIGS. 44 to 46. It is distinguished from the first embodiment by the fact that further includes a pair of support axles 23, 23 formed at a part in corresponding to the pair of the support members 3, 3 respectively, being formed inclined plane 22 at the upper part thereof and a pair of axle holes 24, 24 which is formed at a part in corresponding to the support axles 23, 23 of the support members 3, 3 of a gemstone support bracket 10A attached gemstone 9 including diamond, positioned ocillatably between the support members 3, 3, which is inserted the portion adjacent the tip part of the support axles 23, 23 and supports it on the upper surface thereof. A personal ornament 1M according to the fourteenth embodiment has similar advantages to that according to the first embodiment.

Moreover, In the ninth, tenth, eleventh, twelfth, thirteen and fourteenth embodiment of the present invention, the use of the composition of the first embodiment is explained, however, these embodiment are not intended to be the limits of this invention. The composition of the second to eighth embodiments may be used to the ninth to fourteenth embodiment.

Furthermore, in each embodiment of the present invention, the use of the gemstone support member which attached gemstone including diamond, however, the present invention may be used a member with mirror finish; mirror with pattern, character, letter etc.; or reflector fixed gemstone including small diamond, etc., in addition to pattern, character, letter etc.

In this case, the present invention may be use the gemstone support bracket formed with the reflector in one or formed as another object.

As set forth above, the advantages of the invention are as follows:

(1) Since a personal ornament comprises a support member assembly; a pair of support members formed so as to project upwardly in order that the support member assembly at predetermined space; axle holes formed a part in corresponding to the support members, respectively; a gemstone support bracket located movably between the support members, being attached to a gemstone including diamond; and a pair of support axles provided at a part in corresponding to the axle holes of the support member of the gemstone support bracket, being formed inclined face at the lower part which is supported at lower part adjacent to an opening end of the axle hole, the position of the center of gravity of gemstone including a diamond changes and its motion also shakes automatically by motion of small support member.

Therefore, brightness of gemstone such as a diamond attached to the gemstone support bracket can demonstrate the brightness to the maximum extent.

(2) As discussed above, since the support axle which is formed the lower part thereof in the inclined plane is supported by the lower part adjacent to the opening end of the axle hole of the support member, the gemstone support bracket allows to swing smoothly.

(3) As discussed above, the distance between the axle holes of the support members is formed more greatly than the distance between the tip parts of the support axles.

Therefore, it is easy to attach the gemstone support bracket attached to the gemstone including a diamond to the space between the axle holes.

(4) As discussed above, since the lower part of the support axles is formed in the inclined plane if the gemstone support bracket moves in the axial direction, it can be made to move to the central part automatically by oscillating the gemstone support bracket.

Other embodiments of the invention also provide the same effect as the above-mentioned features (1)–(4).

What is claimed is:

1. A personal ornament comprising:

a support member assembly;

a pair of support members projecting upwardly from the support member assembly opposite one another such that there is a predetermined distance between said support members;

axle holes formed in the support members; a gemstone; and a gemstone support bracket located movably between the support members, the gemstone support bracket being attached to the gemstone, the gemstone support bracket including a pair of support axles engaging with the axle holes of the support members, each of the support axles having a lower inclined surface resting on a surface of the support member defining a respective one of the axle holes and a tip part arranged in the axle hole of the respective one of the support members.

2. A personal ornament according to claim 1, wherein the support member assembly is annular to enable the support member assembly to be put on a person's finger.

3. A personal ornament according to claim 1, wherein the support member assembly including a hanging ring having an aperture through which a chain is adapted to pass.

4. A personal ornament according to claim 1, wherein the support member assembly is formed in a C-shape to enable the support member assembly to be put on a person's wrist.

5. A personal ornament according to claim 1, wherein the support member assembly includes a substrate having first and second opposed surfaces, the support members projecting upward from the first surface, the personal ornament further comprising a safety pin or a clip arranged on the second surface.

6. A personal ornament according to claim 1, further comprising a bolt arranged in each of the support members and defining the axle hole of the support members, the axle holes being formed at a tip part of the bolts.

7. A personal ornament comprising:

a support member assembly including a support member body and a rotation member attached to the support member body and rotatable relative thereto;

a gemstone;

a gemstone support bracket attached to the gemstone, the gemstone support bracket including axle holes; and a pair of support axles arranged on the rotation member to extend into the axle holes to thereby support the gemstone support bracket on the rotation member, wherein the support axles are part of adjustable screws extending through the rotation member.

8. A personal ornament according to claim 3, further comprising a weight attached to the gemstone support bracket to balance the gemstone in order to position the gemstone in a front-facing direction when the support member assembly is hanging on the chain.

9. A personal ornament according to claim 1, wherein the axle hole of each of the support members is formed with a circular hole on a side facing the gemstone support bracket and an inclined surface leading from the circular hole to an inner edge of the support members, the lower inclined surfaces of the support axles of the gemstone support bracket resting on the inclined surfaces of the axle holes.

10. A personal ornament according to claim 9, wherein the tip part of each of the support axles is situated in the circular hole of the axle hole of a respective one of the support members.

11. A personal ornament according to claim 1, wherein the support axles of the gemstone support bracket are shaped as a triangular pyramid with a flat upper side to thereby provide the support axles with a triangular cross-section and the lower inclined surfaces.

12. A personal ornament according to claim 1, wherein the axles holes are cylindrical and extend from a circular opening formed on an inner side of each of the support members.

13. A personal ornament according to claim 1, wherein the support axles of the gemstone support bracket are shaped as a circular cone to thereby provide the support axles with a circular cross-section and the lower inclined surfaces.

14. A personal ornament according to claim 1, wherein the support axles of the gemstone support bracket are shaped as a semi-circular cone with a flat upper side to thereby provide the support axles with a semi-circular cross-section and the lower inclined surfaces.

15. A personal ornament according to claim 1, wherein each of the support members includes an upwardly facing insertion groove communicating with the axle hole in the support member, further comprising insertion groove covers arranged in the insertion grooves after insertion of the support axles of the gemstone support brackets to thereby fix the support axles in the axle holes.

16. A personal ornament according to claim 1, wherein the gemstone support bracket is arranged entirely between opposed inner sides of the support members.

* * * * *